United States Patent [19]

Campbell

[11] 4,195,756

[45] Apr. 1, 1980

[54] AEROSOL CONTAINER CAP AND ACTUATOR

[75] Inventor: S. Jack Campbell, Plantation, Fla.

[73] Assignee: Riviana Foods, Inc., Houston, Tex.

[21] Appl. No.: 905,015

[22] Filed: May 11, 1978

[51] Int. Cl.[2] ..... B67D 5/06

[52] U.S. Cl. ..... 222/182; 222/402.14; 220/256

[58] Field of Search ..... 222/402.14, 402.13, 222/402.15, 182, 179.5; 220/562, 306, 256

[56] References Cited

U.S. PATENT DOCUMENTS

| | | | |
|---|---|---|---|
| 2,980,299 | 4/1961 | Smith | 222/402.13 X |
| 3,081,918 | 3/1963 | Scoggin et al. . | |
| 3,107,827 | 10/1963 | Burmeister . | |
| 3,137,414 | 6/1964 | Steinkamp | 222/402.14 X |
| 3,178,077 | 4/1965 | Benedetto | 222/402.14 X |
| 3,325,064 | 6/1967 | Scheck . | |
| 3,424,354 | 1/1969 | Dykinga | 222/402.14 |
| 3,478,938 | 11/1969 | Krause . | |
| 3,756,472 | 9/1973 | Vos . | |
| 3,765,573 | 10/1973 | Landsman . | |
| 3,804,302 | 4/1974 | Yamada et al. . | |
| 3,901,412 | 8/1975 | Copia | 222/182 |
| 3,920,162 | 11/1975 | Kimura | 222/402.14 X |

*Primary Examiner*—H. Grant Skaggs

[57] ABSTRACT

A two piece aerosol cap and actuator device in which the cap piece is shaped to provide an open end for attachment to an aerosol container and a receptacle at the opposite end to carry an actuator piece for use in locking the aerosol container valve in an open position.

1 Claim, 5 Drawing Figures

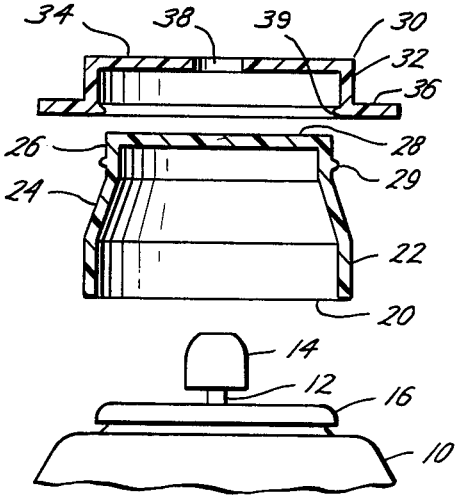
Fig. 1
Fig. 2
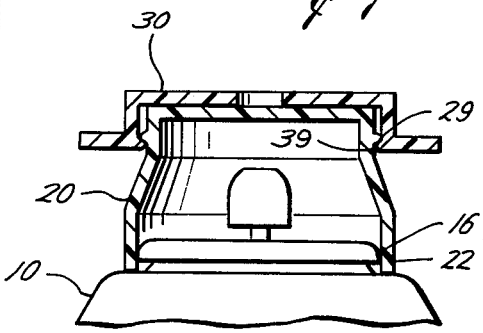
Fig. 3
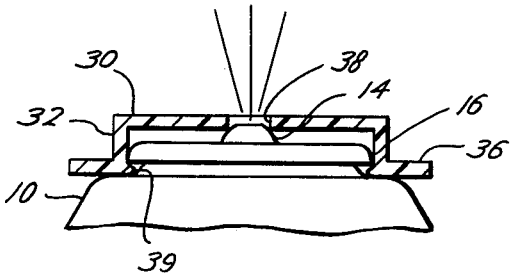
Fig. 4
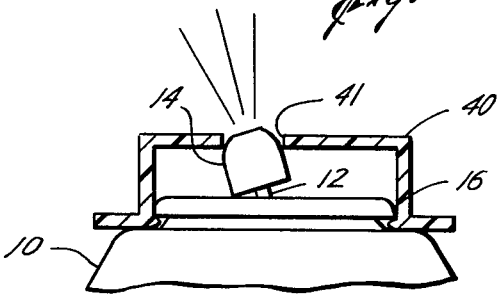
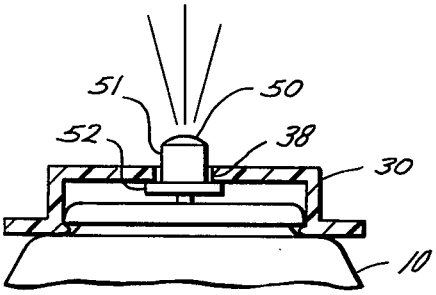
Fig. 5

AEROSOL CONTAINER CAP AND ACTUATOR

BACKGROUND OF THE INVENTION

This invention relates to aerosol container caps and actuators for use in locking the aerosol valve in its open position, thereby allowing the contents of the container to discharge while unattended.

The prior art has long recognized the need for a device which will allow the contents of an aerosol container to be completely discharged while unattended.

In aerosol containers, the aerosol valve is connected by a discharge tube to an actuator button, the actuator button usually incorporating a nozzle for dispensing a fine spray or mist. The valve is generally biased toward its closed position by a spring or similar means. Assuming the aerosol container to be in an upright position, with the actuator button atop the container, the valve ordinarily is urged open by either depressing the actuator button downwards or by applying a lateral force to the actuator button to deflect the button and discharge tube sideways (depending upon the valve structure). Ordinarily, the actuator button is operated by a human finger. However, for certain products in aerosol containers, such as insect foggers, it is desirable to dispense the entire contents of the container while minimizing human contact with the container during the time the contents are being discharged. This function may be performed by a device which holds the actuator button in its discharge position.

Patents such as Copia, U.S. Pat. No. 3,901,412 (1975) and Scoggin et al., U.S. Pat. No. 3,081,918 (1963) illustrate the use of a latching hook attached to the actuator button which, upon lateral movement of the actuator button, engages the lip of the aerosol can and thereby locks the aerosol valve in an open position. The latching hook may be either molded as an integral part of the actuator button or attached as a separate sleeve over the actuator button. However, a latching hook as described in these patents is not suitable for use on an aerosol container which requires the actuator button to be maintained in a depressed position rather than a laterally deflected position.

A variety of "clip" type devices for depressing the actuator button and locking the aerosol valve in an open position are also contained in the prior art. See, for example, the clip in Dykinga, U.S. Pat. No. 3,424,354 (1969), and the wire clips of Burmeister, U.S. Pat. No. 3,107,827 (1963) and Krause, U.S. Pat. No. 3,478,938 (1969). All of these clips are designed to hold the actuator button in a depressed position and thereby allow for continuous, unattended discharge of the contents of the aerosol container.

The use of a locking sleeve is disclosed in Scheck, U.S. Pat. No. 3,325,064 (1967), in which an elastic tube or sleeve frictionally engages the actuator button and a portion of the container to hold the actuator button in its depressed position.

A more sophisticated locking device for an aerosol container is disclosed in Vos, U.S. Pat. No. 3,756,472, (1973) in which the actuator button is maintained in a depressed position by a two piece cap, one piece of which is cylindrical and snaps onto the rim of the aerosol container while the second piece is threadedly mounted on the first piece. Rotation of the two pieces with respect to each other causes the pieces to move axially with respect to each other. This axial movement of the second piece causes it to engage the actuator button and maintain the same in a depressed position.

Another two piece cap is disclosed in Yamada et al., U.S. Pat. No. 3,804,302 (1974), in which the first piece is a cylindrical cap which snaps onto the rim of the aerosol container, while a smaller plug or "presser member" is movably mounted in the top of the first piece and may be engaged against the actuator button to maintain the same in a depressed position. Several embodiments of the plug are shown.

The device disclosed in Landsman, U.S. Pat. No. 3,765,573 (1973), is adpatable for use with an aerosol valve which is activated by either vertical or lateral movement of the discharge tube. The two piece combination in Landsman consists of a cylindrical first piece which has female couplings at both ends for snapping onto a rim of the aerosol container, and a second piece which merely serves as a cap for the first piece. A wall extends transversely across the first piece at a point closer to one end than the other. When one end of the first piece is mounted on the aerosol container, and the second piece or cap is snapped onto the other end, the combination serves to protect the aerosol valve against inadvertent discharge or contamination. When the cap is removed and the first piece is reversed, the discharge tube is held in a depressed or laterally shifted position (depending upon the type of valve used on the container).

The present invention may be adapted to function with either a vertically depressable or laterally actuated aerosol valve, unlike either the Copia or Scoggin et al. devices. Moreover, the cap of the invention disclosed herein completely seals the area of the actuator button and thereby protects against contamination, unlike the devices disclosed in Yamada or Vos. Additionally, because of its simplified design, the present invention is easier and less expensive to manufacture than the clips shown in Krause and Burmeister. Since the two parts of the present invention interconnect and attach to the aerosol container, the actuator portion of the invention is less likely to become misplaced or lost prior to use than the clip shown in Dykinga. The relatively simple shapes of the parts of the invention disclosed herein are easy to mold, and therefore less expensive than the devices disclosed in Vos Yamada, and Landsman.

Accordingly, an object of this invention is to provide a simple and extremely inexpensive device to use in connection with an aerosol container for allowing unattended discharge of the aerosol container.

Another object of the invention is to provide such a device which is very simple to manufacture.

Yet another object of the invention is to provide a two piece cap and actuator combination for an aerosol container which completely seals and thereby protects the area of the actuator button when not in use, and in which the actuator piece is unlikely to be lost or misplaced prior to use by the consumer.

Other objects and purposes of this invention will appear from the following descriptions, examples, and claims.

BRIEF DESCRIPTION OF THE DRAWINGS

FIG. 1 is an exploded view of the top of an aerosol container and the pieces of the device.

FIG. 2 is a sectional view of the device as stored on the aerosol container prior to use.

FIG. 3 is a sectional view of the actuator in place on the aerosol container for discharging the contents thereof.

FIG. 4 is a sectional view of a modified form of the invention.

FIG. 5 is a sectional view of another modified form of the invention.

SUMMARY OF THE INVENTION

The novel cap and actuator device comprises two pieces, one of which serves as a cap which is capable of completely sealing the area of the actuator button of the aerosol container. The second piece serves as a locking actuator for the actuator button of the aerosol container, and is able to be stored atop the cap piece when not in use. Thus, the actuator piece is not easily lost or misplaced prior to use, as would ordinarily be the case when a separate actuator is used. Moreover, both pieces are extremely simple in shape to facilitate manufacture of the same.

DESCRIPTION OF THE PREFERRED EMBODIMENTS

The basic elements of the device are clearly shown in FIG. 1. Aerosol container 10 has a discharge tube 12, which is connected at the other end to an actuator button 14. The actuator button 14 also serves as a nozzle for dispensing a fine mist composed of the contents of the aerosol container 10. The container 10 also has a circular lip 16 extending around the discharge tube.

The cap/actuator device is in two pieces, 20 and 30. The cap piece 20 has a generally cylindrical lower wall portion 22, a tapered wall portion 24, a cylindrical upper wall portion 26, and a top portion 28. A bead 29 extends around the exterior of the upper wall 26. The interior of the lower wall 22 is dimensioned such that the cap 20 will fit over the actuator button 14 and slidingly engage the lip or rim 16 of the container 10, as shown in FIG. 2. A snug fit between the lip 16 and the interior of the wall 22 provides for frictional engagement of the cap 20 with the container 10, and effectively seals the area surrounding the actuator button 14, thereby protecting against inadvertent discharge of the contents of the container as well as preventing dust, dirt, fluids, and other materials from contaminating or clogging the nozzle of the actuator button 14. Indeed, depending upon the material of which the cap 20 is made and the dimensions of the cap 20, the lower wall 22 may stretch slightly when engaging the lip 16 to provide an extra measure of security and effective seal.

The actuator 30 has a generally cylindrical wall portion 32, a top portion 34, and a flange 36 extending around the lower portion of wall 32. The flange 36 facilitates removal and attachment of the actuator 30. A hole 38 is centrally located in the top portion 34. A bead 39 extends around the lower interior of the wall 32. The bead 39 may be continuous as shown, or a series of spaced segments.

The interior of the wall 32 (together with the bead 39) is shaped and dimensioned to fit over the upper wall 26 (together with the bead 29) of the cap 20. The beads 29 and 39 provide for an interengaging or "snap" fit, as shown in FIG. 2. Additionally, the interior of the actuator wall 32 is shaped and dimensioned to fit around the lip 16 of the container 10. This means that the shape and dimensions of the exterior of the upper wall 28 and bead 29 of the cap 20 must closely approximate the shape and dimensions of the lip 16.

This novel design of the cap 20 allows the actuator 30 to be securely attached to the top of the cap 20 while the cap 20 sealingly protects the actuator button 14.

The cap 20 and the actuator 30 may be made of any suitable material, such as plastic, metal, etc. However, for ease of manufacture and inexpensive production, a moldable plastic is preferable. The material of the cap 20 may be somewhat softer and more flexible than the material of the actuator 30, as the cap need be rigid enough only to protect the actuator button 14 against accidental discharge, while the actuator 30 must be sufficiently rigid to maintain the actuator button 14 in a depressed or shifted position. Both the cap and actuator may be made of polyethylene, with the actuator being made of a higher density polyethylene than the cap to provide the required additional rigidity.

To discharge the contents of the container 10, the actuator 30 is removed from the cap 20, the cap 20 is removed from the container 10, and the actuator 30 is snapped onto the lip 16 of the container 10, as shown in FIG. 3. This depresses the actuator button 14, allowing the contents of the container 10 to be discharged through the hole 38 in the actuator 30. Once the actuator 30 has been snapped on the container 10, the button 14 will remain depressed, allowing the contents to be completely discharged while unattended. The bead 39 serves to securely hold the actuator 30 in position.

FIG. 4 illustrates a modified form of the invention for use with an aerosol valve which is opened by lateral movement of the discharge tube 12 rather than axial movement of the same. The modified actuator 40 has an eccentric hole 41 such that the actuator button 14 is caught in the hole 41 and held in a laterally shifted position when the actuator 41 is snapped on the lip 16. This allows the contents of the container to be discharged through hole 41.

Another modification of the invention is shown in FIG. 5. The actuator button 50 has a generally cylindrical portion 51 and a flange 52 at the bottom. The diameter of the circular hole 38 in the actuator 30 is dimensioned larger than the diameter of the cylindrical portion 51 of the actuator button 50, but smaller than the diameter of the flange 52. Thus, when the actuator 30 is snapped on the lip 16 of the container 10, the actuator button 50 is depressed as that portion of the actuator surrounding the hole 39 presses on the flange 51.

I claim:

1. A two-piece cap and actuator device for an aerosol container having a valve element on its top, comprising:

a tubular cap element having male and female ends, said female end being shaped and dimensioned to releasably engage the top of the aerosol container and said male end being closed and being dimensioned similarly to said top of said aerosol container, said cap element when engaged on said top of the aerosol container forming a protective barrier surrounding the valve element; and a circular actuator element shaped and dimensioned to releasably engage either the top of the aerosol container or the male end of the cap element interchangeably, said actuator element having at least one hole for engaging and actuating the valve of the aerosol container in such a manner as to continuously release the contents of the aerosol container in a substantially vertical direction through said hole when the container is upright.

* * * * *